US005695098A

United States Patent [19]

King

[11] Patent Number: 5,695,098

[45] Date of Patent: Dec. 9, 1997

[54] SAFETY PAINT BUCKET

[76] Inventor: Scott Edward King, 3341 Owens Brook Way, Kennesaw, Ga. 30152

[21] Appl. No.: 511,406

[22] Filed: Aug. 4, 1995

[51] Int. Cl.[6] ..... A45F 5/00

[52] U.S. Cl. ..... 224/148.7; 224/610; 224/666; 224/197; 224/679; 224/241

[58] Field of Search ..... 224/148.1, 148.7, 224/197, 609, 610, 611, 612, 676, 678, 679, 235, 241, 270; 206/361, 209, 366, 363, 370; 220/334, 348, 694, 699, 259, 264, 666

[56] References Cited

U.S. PATENT DOCUMENTS

| | | | |
|---|---|---|---|
| 276,760 | 12/1883 | Kesterson | D2/400 |
| 3,997,092 | 12/1976 | Pogwizd | 224/610 |
| 4,057,794 | 11/1977 | Grossfield | 224/666 |
| 4,119,248 | 10/1978 | Butler et al. | 224/611 |
| 4,323,181 | 4/1982 | Spasoff | 224/679 |
| 4,325,503 | 4/1982 | Swinney | 224/148 |
| 4,375,863 | 3/1983 | Kappler | 220/264 |
| 4,890,733 | 1/1990 | Anderson | 206/366 |
| 5,004,136 | 4/1991 | Leath | 224/253 |
| 5,009,222 | 4/1991 | Her | 224/666 |
| 5,016,791 | 5/1991 | Burow | 224/148 |
| 5,067,643 | 11/1991 | McKinney | 224/197 |
| 5,145,063 | 9/1992 | Lee | 206/370 |
| 5,163,591 | 11/1992 | Leiserson et al. | 224/148 |
| 5,170,904 | 12/1992 | Neuhaus | 220/264 |
| 5,489,051 | 2/1996 | Robinson | 224/148.7 |
| 5,501,340 | 3/1996 | Stafford | 206/361 |

*Primary Examiner*—Henry J. Recla
*Assistant Examiner*—Gregory M. Vidovich
*Attorney, Agent, or Firm*—Isaf, Vaughan & Kerr; Charles H. Fails

[57] ABSTRACT

A spill and splash resistant safety paint bucket for supporting and transporting paints or other liquids is disclosed. The safety paint bucket includes a container for supporting the paint or other liquid and a self-closing lid constructed to be removably attached to the container. The container includes a belt clip attachment and shoulder strap attachment buttons so that the safety paint bucket can be attached to a belt or harness, or carried on an attached strap by an individual while maintaining both hands free to perform other tasks. The lid includes a fixed partition, a spring loaded flap, and a spring. When a brush or other applicator is inserted into the container through the top of the lid, the downward pressure applied to the brush or other applicator compresses the spring which allows the spring loaded flap to pivot away from the fixed partition. The opening thus created allows the brush or other applicator to reach the liquid contained below. When the brush or other applicator is withdrawn from the safety paint bucket, tension applied to the spring loaded flap by the spring urges the spring loaded flap to pivot toward the fixed partition. As this occurs, excess liquid is scraped from the brush or other applicator by the spring loaded flap. When the brush or other applicator is fully withdrawn from the opening in the lid, the spring loaded flap snaps back into contact with the fixed partition and the lid is again closed.

7 Claims, 2 Drawing Sheets

SAFETY PAINT BUCKET

FIELD OF THE INVENTION

This invention relates in general to portable liquid containers. More particularly, this invention relates to a spill resistant container assembly for holding and dispensing paint or other liquids and for being carried without the use of hands.

BACKGROUND OF THE INVENTION

Heretofore, various belt and harness supports have been employed for the general objective of carrying paint and other materials without the use of hands. However, because of the complexity and amount of movement required when climbing ladders, scaffolding and the like, such devices have been difficult and impractical to use when carrying paint or other liquids.

Early belt and harness apparatuses performed the support function, but were limited with respect to the range of motion of the individual wearing the belt or harness. Although a number of such devices maintain the article to be supported in a generally upright position when an individual stands erect, these devices are susceptible to tipping and oscillation when the individual's movement becomes too quick or otherwise extends too far beyond the vertical plane. When such devices support containers holding paint or other liquids, this tipping and oscillation results in splashing and spillage of the paint or other liquid which in turn causes damage to the individual's clothing and the surrounding property.

An early example of such a belt apparatus is disclosed in the patent of Swinney, U.S. Pat. No. 4,325,503, issued Apr. 20, 1982. Swinney discloses a rack for supporting a paint bucket that is hingedly secured to a member supportable by a belt that is worn around the waist of a user. The hinge allows for relative movement of the rack in the vertical plane when the device is being worn by the user.

Although the invention of Swinney allows limited movement in the vertical plane, it does not allow the rack to move in the horizontal plane. Thus, since the device of Swinney does not incorporate a lid or cover, the device cannot prevent splashing or spillage of the paint supported on the rack.

A similar approach for supporting a paint can on a belt is disclosed in U.S. Pat. No. D276,760 to Kesterson, issued Dec. 18, 1984. Kesterson discloses the ornamental design for a belt-attached can holder. Much like the device of Swinney, Kesterson does not incorporate a container and lid assembly for preventing spillage of the paint or other liquid contained therein.

Advancements in the art are disclosed in U.S. Pat. No. 5,016,791 to Burow, issued May 21, 1991, and in U.S. Pat. No. 5,163,591 to Leiserson et al., issued Nov. 17, 1992. In both Burow and Leiserson et al., a device is disclosed for carrying a paint can or bucket at hip level. Leiserson et al. discloses a paint bucket holster for suspending a container from a painter's waist formed of an oblong panel which is suspended from its mid-section to the outer face of the belt by a hook and ring assembly so that the upper end of the panel is engaged between the belt and the waist of the user. Burow discloses a hip level pail carrier characterized by a girdle secured to the hips of the painter. The pail is supported against an apron depending from the girdle which allows the pail to swing along a horizontal axis. Both Burow and Leiserson et al. maintain the pail in a generally vertical position by allowing relative movement of the pail along the horizontal axis. However, neither Burow nor Leiserson et al. disclose a container having a lid for preventing spillage of the paint or other liquid which necessarily results from the quick unexpected movements of a painter.

Additional examples of belt and harness apparatuses for supporting a variety of articles about an individual's waist are disclosed in U.S. Pat. No. 5,004,136 to Leath, and U.S. Pat. No. 5,067,643 to McKinney. Both disclosures are less pertinent to the construction and design of the present invention as neither is designed for supporting paint containers.

While several of the belt and harness apparatuses described above have permitted the support of paint containers at or near the waist of a painter, it appears that none disclose a container and lid assembly which prevent the spillage of paint which necessarily results from the natural movements of a painter when climbing ladders and scaffolding. Additionally, none of the above-mentioned devices provide a means for removing excess paint or liquid from a brush or other applicator when the brush or applicator is withdrawn from the container.

What is needed, therefore, but seemingly unavailable in the art, is a paint container assembly having a lid that prevents the spillage of paint or other liquids, while allowing easy access for the insertion of a brush or other applicator. Moreover, what is needed but unavailable in the art is a paint container assembly having a lid that is self-closing to facilitate the removal of excess paint or other liquids from the brush or other applicator while the brush or other applicator is being withdrawn from the container.

SUMMARY OF THE INVENTION

The present invention provides an improved safety paint bucket for use by a painter which overcomes some of the design deficiencies of other paint bucket assemblies known in the art. The safety paint bucket of this invention provides a novel method and apparatus for safely containing and transporting paints or other liquids while conducting painting operations. The safety paint bucket further provides a novel method and apparatus for removing excess paint or other liquids from the brush or other applicator used to apply the paint or other liquid to the object being painted.

The safety paint bucket is designed to enable a person to carry paints or other liquids while leaving both hands free to perform other tasks. One hand can thus be used to support the painter while climbing and maneuvering upon ladders and scaffolding, while the other hand can be used to apply the paint or other liquids being carried.

The safety paint bucket includes a container for holding the paint or other liquid and a lid sized and shaped to be received on the open end of the container. The lid can be constructed of numerous materials commonly known in the art, such as, but not limited to, metal, fiberglass, plastic and plexiglass. The container can be made from various materials and production processes. Additionally, the container can be manufactured in numerous shapes and sizes. Generally speaking, the lid is correspondingly sized and shaped to mate with the open end of the container. However, the lid can also be sized and shaped to be received on standard one gallon or one quart paint cans typically manufactured in the paint industry. In this embodiment of the present invention, the standard paint can functions as the container of the safety paint bucket.

The container further includes at least one belt clip attachment and at least two shoulder strap attachment buttons so that the safety paint bucket, when worn, is in close proximity to the painter's body. The belt clip attachment can be used to removably secure the paint bucket to a painter's belt, other article of clothing or equipment, and the shoulder strap attachment buttons can be used in conjunction with a shoulder strap so that the paint bucket can be worn at or near waist level. To provide for greater flexibility, the container generally includes both types of supports so that the painter can determine the manner in which the safety paint bucket will be worn.

The belt clip attachment is pivotally secured to the container, and the shoulder strap attachment buttons are designed to receive the shoulder strap such that the shoulder strap is capable of rotation on the buttons. The paint bucket can therefore pivot in response to the painter's movements thereby maintaining the paint bucket in a generally upright position. While it is preferable to manufacture the container with both the belt clip attachment and the shoulder strap attachment buttons so that the painter can choose the manner in which the paint bucket is worn, the paint bucket can be constructed with only the shoulder strap attachment buttons.

The lid includes a spring loaded flap, a fixed partition, and a spring, and is sized and shaped to engage the open end of the container. The lid can be formed in any number of sizes and geometric shapes provided the size and shape allows the lid to be mated with a correspondingly sized and shaped open end of the container. Thus, when the lid is designed to be used with a standard paint can, the lid will be circular in shape and sized to fit the opened end of a standard one gallon or one quart paint can.

Generally, the lid is snapped into engagement with the open end of the container thereby sealing the periphery of the container's open end to prevent spillage of the paint or other liquid within the container. In this embodiment, the lid can be quickly and easily secured to and removed from the container. This allows for quick and convenient filling, emptying, and cleaning of the safety paint bucket. The lid can also be designed so that it can be secured to the open end of the container with any number of latch or hinge assemblies commonly known in the art. In addition to providing extra support for the lid, such devices enable the lid to be attached to the container without being in a fully closed position.

Once the lid is secured to the container, the paint or other liquid stored within the container is accessed through a self-closing opening in the top of the lid. The opening is generally formed with a fixed partition, a spring loaded flap, and a spring. The spring loaded flap is hingedly secured at one end to the lid and its movement is controlled by the spring. The spring can be a springing device connected with the interior of the lid the spring loaded flap. Tension in the spring applies pressure to the spring loaded flap which in turn causes the spring loaded flap to come into contact with the fixed partition. Thus, when the safety paint bucket is not in use, the opening in the lid remains closed.

To access the paint or other liquid within the container through the lid, a brush or other applicator is forced downward at or through the opening of the lid. The force applied to the spring loaded flap is transferred to the spring causing it to compress. As the spring compresses, the spring loaded flap rotates inward through an arc creating a gap between the fixed partition and the spring loaded flap. The opening created enables the brush or other applicator to reach the paint or other liquid within the container. As the brush or other applicator is withdrawn from the paint bucket, tension provided by the spring simultaneously urges the spring loaded flap in the direction of the fixed partition. The resulting pressure applied to the brush or other applicator thereby removes the excess paint or other liquid from the brush or other applicator as it is withdrawn. Once the brush or other applicator is fully withdrawn from the safety paint bucket, the spring loaded flap is again urged into contact with the fixed partition and the opening in the lid is fully closed. Because the excess paint or other liquid was removed by pressure applied by the spring loaded flap, the problems of having excess paint on the brush and dripping are solved. The painter no longer has to wipe excess paint from the brush prior to painting.

To further facilitate paint removal and prevent dripping, both the fixed partition and the spring loaded flap are angled downward with respect to the top of the lid. Thus, when the opening in the lid is closed and the fixed partition and spring loaded flap are in contact, a V-shaped channel is formed. As a result, residual paint build-up on the lid resulting from repeated insertions of the brush or other applicator will be trapped in the channel rather than run down the side of the container.

The lid of this invention may also be constructed with a second spring loaded flap rather than a fixed partition. Such a double spring loaded flap configuration can be operated either singularly or in unison with the other of the spring loaded flaps thereby allowing a painter to vary the pressure applied to the brush or other applicator being withdrawn from the safety paint bucket.

The container of this invention could also be designed with any of a number of depth adjustment mechanisms that are commonly known in the art. A container equipped with such a mechanism, enables the painter to have easy access to the paint or other liquid as the quantity of liquid within the container decreases.

The safety paint bucket, as described, will accept a wide variety of applicators such as brushes, sponges, small rollers, window washing devices, as well as, other devices known in the art. In addition, the assembly will hold a number of liquids, including, but not limited to waterproofing liquid, cleaning fluids, sealers, stains and paints. Additionally, the safety paint bucket could be used to hold small parts such as nuts, bolts or screws. The novel lid of this assembly would allow easy access to such small parts, yet would prevent them from being spilled.

The cooperation of the structural elements of this invention results in a safety paint bucket which allows an individual to safely and efficiently transport and apply paint or other liquids without having to carry the supply of paint or other liquid with one hand. Moreover, the apparatus of this invention prevents spillage and splashing of the paint or other liquid contained therein, and further, provides a way to remove excess paint or other liquid from a brush or other applicator, automatically. Accordingly, the objects of the present invention include providing a safety paint bucket having a self-closing lid, a belt clip and shoulder strap attachment for ease of transport and a removable lid so that a painter can support himself safely upon ladders, scaffolds and the like with one hand while applying paint or other liquids with the other hand. Additional objects of the present invention are that the safety paint bucket is light weight, compact in size and inexpensive to manufacture.

The numerous objects and advantages of the present invention will be more readily apparent from the following detailed description, read in conjunction with the accompanying drawings.

DETAILED DESCRIPTION OF THE PREFERRED EMBODIMENT

Figure 1:
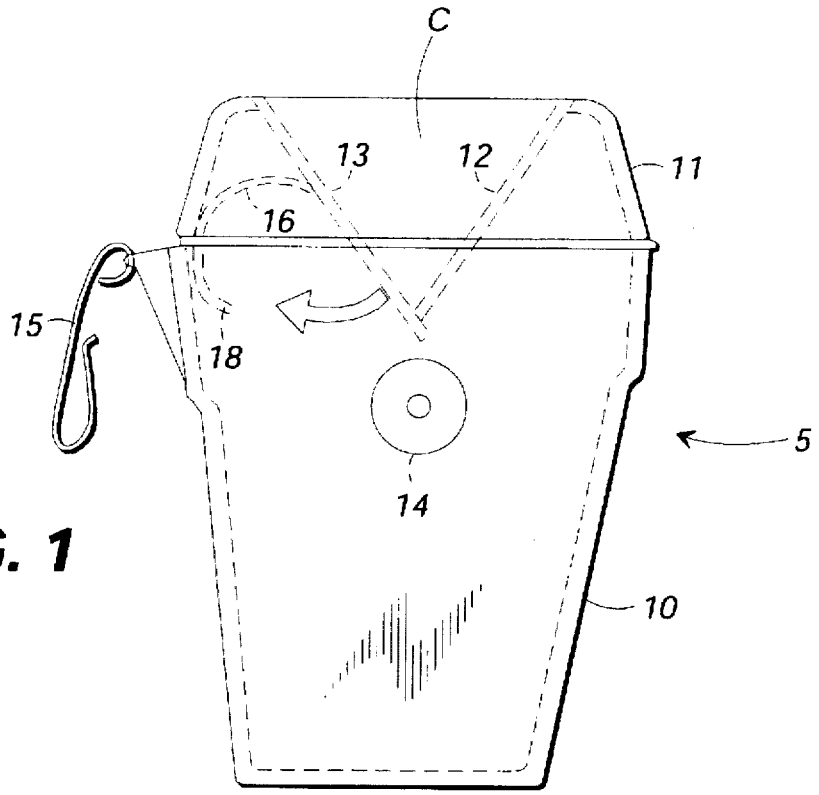
FIG. 1 is a side elevational view of a preferred embodiment of the safety paint bucket of this invention.

Referring now to the drawings, in which like reference characters indicate like parts throughout the several views, numeral 5 of FIG. 1 illustrates a preferred embodiment of the safety paint bucket. The safety paint bucket comprises a container 10 and a lid 11 mated to the open end (not illustrated) of the container 10. In the preferred embodiment of the invention, the container 10 is generally rectangular in shape and has affixed to its exterior surface at least one belt clip attachment 15 and a plurality of shoulder strap attachment buttons 14. Either or both of these elements are used to support the safety paint bucket in close proximity to the body of an individual using the device.

The lid 11 as shown in FIGS. 1–4 is generally rectangular in shape and is sized for attachment to the open end of the container 10. The lid comprises a fixed partition 12, a spring loaded flap 13 and a spring 16. The fixed partition 12 is rigidly connected along one side to the top of the lid 11 and extends downward at an angle toward the center of the container 10. The spring loaded flap 13 is pivotally mounted along the opposite side of the top of the container 10 and also extends downward at an angle toward the center of the container 10. Connected in such manner, the spring loaded flap 13 and the fixed partition 12 form a V-shaped channel (identified by reference character "C" in the drawing figures) in the lid for capturing runoff liquids. Spring 16 is attached to the interior wall of the lid 11, and is also attached to the spring loaded flap 13 intermediate its ends. Tension provided by the spring urges the spring loaded flap 13 into contact with the fixed partition when the safety paint bucket is not in use.

Figure 2:
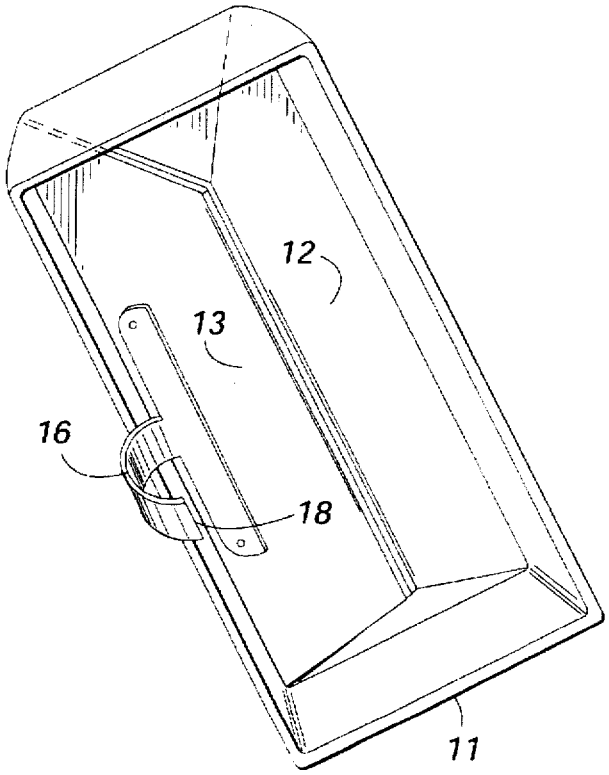
FIG. 2 is a bottom perspective view of the lid for the safety paint bucket of FIG. 1.

As seen in greater detail in FIG. 2, one end of the spring 16 is in connection with the spring loaded flap 13. An arcuate resilient portion 18 extends outward therefrom beyond the sidewalls of the lid 11. As shown in FIG. 1, when the lid 11 is snapped into engagement with the container 10, the arcuate portion 18 of the spring 16 is forced into contact with an interior wall of the container 10.

Although spring 16 is shown in connection with the spring loaded flap 13, numerous types of springing devices can be used with the present invention. Spring 16 is also in connection with the spring loaded flap 13. In yet another embodiment (not illustrated), the lid 11 is designed with a second spring loaded flap 13 and spring 16 in lieu of the fixed partition 12. In this way, both spring loaded flaps 13 are capable of pivoting.

Figure 3:
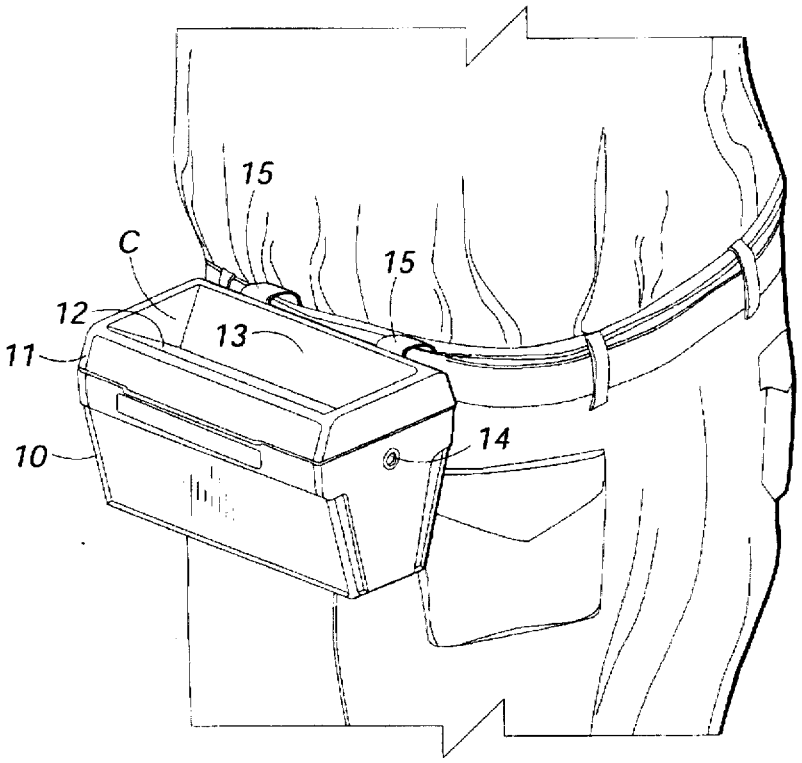
FIG. 3 is a perspective view of the safety paint bucket of FIG. 1 attached to an individual's belt with the belt clip attachments.

In FIG. 3, the safety paint bucket is shown supported on the belt of an individual. The safety paint bucket 5 is removably secured to the belt with a spaced pair of belt clip attachments 15 such that the safety paint bucket 5 is in close proximity with the body of the individual. As seen in FIG. 1, the belt clip attachment 15 is pivotally connected to one side of the container 10. When worn as shown in FIG. 3, the safety paint bucket 5 is permitted to pivot vertically at its belt clip attachment 15 pivot points. When the individual maneuvers upon ladders or scaffolding, the safety paint bucket 5 thus tends to remain generally upright.

Figure 4:
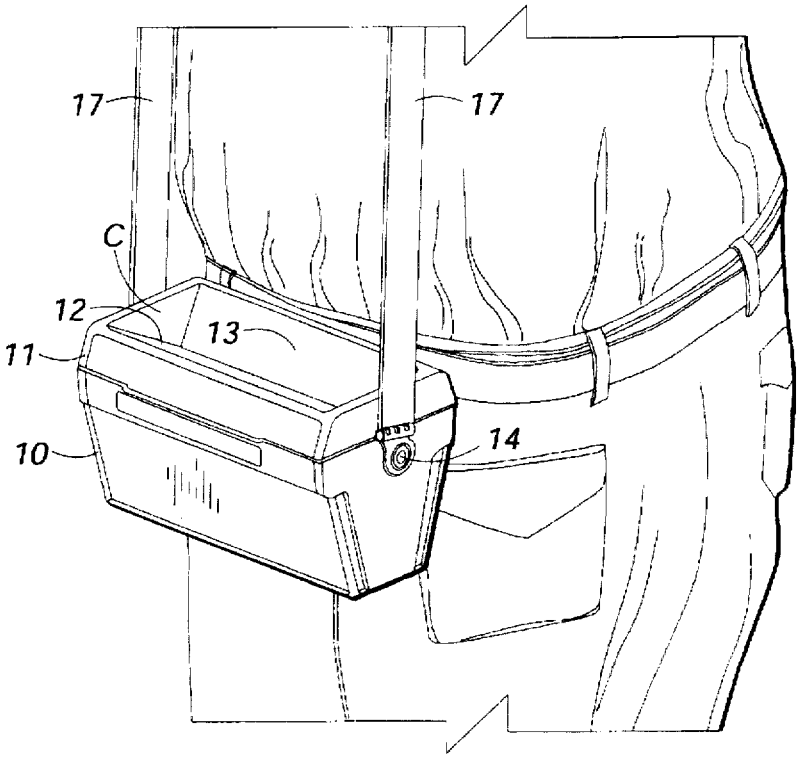
FIG. 4 is the safety paint bucket of FIG. 1 supported on an individual's shoulder with a shoulder strap.

In FIG. 4, the safety paint bucket 5 is shown supported on the shoulder of an individual with a shoulder strap 17. The shoulder strap 17 is pivotally secured at each of its ends to one of each of the shoulder strap attachment buttons 14 affixed to the exterior sidewall of container 10. In the embodiment of FIG. 3, the safety paint bucket 5 is worn at approximately waist level along the side of the individual. However, in the embodiment of FIG. 4, the shoulder strap 17 can be adjusted so that the safety paint bucket 5 will rest at or below waist level. Additionally, the shoulder strap 17 can be worn around other parts of an individual's body so that the safety paint bucket 5 hangs, for instance, in front of the individual. Supporting the safety paint bucket 5 with the shoulder strap 17 allows the safety paint bucket 5 to swing in both the vertical and horizontal plane, thus allowing the individual greater range of movement while maintaining the safety paint bucket 5 in a generally upright position.

The safety paint bucket 5 as shown and described can be manufactured such that it is light weight for ease of transport. The generally rectangular shape of the safety paint bucket 5 provides greater stability when worn by an individual since more surface area is in contact with the individual's body.

In operation, the lid 11 is removed from the container 10 so that the container 10 can be filled with the desired quantity of paint or other liquid to be applied. Once filled, the lid 11 is snapped into engagement with the container 10 thereby sealing the periphery of the container 10 opening. As shown in FIG. 1, the opening in the lid 11 is in the closed position due to the pressure applied to the spring loaded flap 13 by spring 16. Thus configured, the safety paint bucket 5 prevents paint or other liquids from spilling when the safety paint bucket is tipped or otherwise moved excessively.

The safety paint bucket 5 is then secured to the individual's body with either the belt clip attachments 15 as shown in FIG. 3, or the shoulder strap 17 as shown in FIG. 4. With both hands free to perform other tasks, the paint or other liquid can now be easily transported as the individual moves upon ladders, scaffolding and the like.

To access the paint or other liquid stored within the container 10, the individual positions the brush or other applicator within the V-shaped channel illustrated in FIG. 1, and formed by the fixed partition 12 and the spring loaded flap 13 in the closed position. The individual then exerts a downward force upon the brush or other applicator. As the downward pressure is applied to the spring loaded flap 13, the flap 13 is biased in the direction of the arrow as shown in FIG. 1. Additional tension is simultaneously placed upon spring 16 causing it to compress. As the spring loaded flap 13 continues to pivot, an opening is created between the now opened, or spaced, sides of the spring loaded flap 13 and the fixed partition 12. Thus, the spring loaded flap 13 is biased open with respect to the fixed partition 12. As the individual continues to apply downward force to the brush or other applicator, the brush or other applicator enters the container 10 through this opening.

Once the desired quantity of paint or other liquid is captured by the brush or other applicator, the individual then withdraws the brush or other applicator from the safety paint bucket. Because there is no downward pressure being applied to the brush or other applicator, tension from the spring 16 urges the spring loaded flap 13 to pivot back in the direction of the fixed partition 12. This pressure is in turn applied to the brush or other applicator as it is withdrawn through the opening in the lid 11. Excess paint or other liquid is thereby scraped from the brush or other applicator as it is withdrawn. As the brush or other applicator passes the spring loaded flap 13, the flap 13 is urged into engagement with the fixed partition 12 and the lid is again closed. The individual is then free to apply the paint or other liquid to the object being painted without having to first remove excess paint from the brush or other applicator.

This process is repeated until painting operations are complete or until no more paint remains in the container 10. To add additional paint, the lid 11 is simply removed and additional paint is poured into container 10. Due to the novel arrangement of the spring loaded flap 13 and the fixed partition 12, excess paint build-up on the surfaces of the spring loaded flap 13 and the fixed partition 12, due to repeated insertions of the brush or other applicator, is minimized. The downward angle of the spring loaded flap 13 and the fixed partition 12 allows excess paint to run down into the container 10 each time the brush or other applicator is inserted into the safety paint bucket 5.

While the principles of the invention and the features thereof have been shown and described in an apparatus for supporting paint or other liquids, it can be appreciated that the same principles can be applied for supporting and transporting other items, such as, small parts, screws, bolts or other parts.

While a preferred embodiment of the invention has been disclosed in the foregoing specification, it is understood by those skilled in the art that variations and modifications thereof can be made without departing from the spirit and scope of the invention as set forth in the following claims. In addition, the corresponding structures, materials, acts, and equivalents of all means or step plus function elements in the claims below are intended to include any structure, material or acts for performing the functions in combination with other claimed elements as specifically claimed herein.

What is claimed is:

1. An apparatus for transporting and dispensing liquids, said apparatus being adapted to receive paint brushes and other liquid applicators, said apparatus comprising:

a container for carrying liquids, said container including a closed end, a spaced open end, and a continuous sidewall sealed on said closed end and extending toward said open end;

a lid sized and shaped to be mated on the open end of the container, said lid including an inwardly extending fixed partition extending along a side of said lid, a spring loaded flap hingedly secured to an opposite side of said lid and extending inwardly therefrom, and a spring positioned between said spring loaded flap and said opposite side of said lid for urging said spring loaded flap into a closed position against said fixed partition;

at least one belt clip attachment pivotally secured to the container; and a plurality of spaced shoulder strap attachment buttons affixed to the exterior of the container.

2. The apparatus as claimed in claim 1, wherein said lid is sized and shaped to snap fit onto the open end of the container for sealing the periphery of the open end of the container.

3. An apparatus as claimed in claim 2, wherein said fixed partition extends downwardly from the lid at an angle with respect to the container sidewall.

4. The apparatus as claimed in claim 3, wherein said spring is in connection with said spring loaded flap intermediate the ends thereof and bearing on the interior of the container sidewall, the fixed partition and the spring loaded flap being constructed and arranged to form a V-shaped channel as said spring loaded flap is urged into engagement with said fixed partition by said spring.

5. The apparatus as claimed in claim 4, wherein said spring is constructed and arranged to be biased as said spring loaded flap pivots away from the fixed partition into an open position when the paint brush is pushed against said spring loaded flap, and wherein said spring urges said spring loaded flap to pivot in the direction of the fixed partition into a closed position against said fixed partition when the brush is pulled away from the spring loaded flap.

6. The apparatus as claimed in claim 1, wherein said belt clip attachment is sized and shaped for being removably attached to the belt of an individual.

7. The apparatus as claimed in claim 1, further comprising a shoulder strap for pivotal attachment to said shoulder strap attachment buttons.

* * * * *